US005146974A

United States Patent [19]

Mayer et al.

[11] Patent Number: 5,146,974

[45] Date of Patent: Sep. 15, 1992

[54] LEAD POURING SYSTEM

[75] Inventors: Robert W. Mayer, Milwaukee; James B. Nowakowski, Brookfield; Bruce A. Pusey, Milwaukee; Kashyap H. Shah, Menomonee Falls, all of Wis.

[73] Assignee: Globe-Union Inc., Milwaukee, Wis.

[21] Appl. No.: 591,611

[22] Filed: Oct. 2, 1990

[51] Int. Cl.[5] ..... B22D 17/06; B22D 17/30

[52] U.S. Cl. ..... 164/309; 164/337; 222/595

[58] Field of Search ..... 164/306, 309, 335, 337; 222/595

[56] References Cited

U.S. PATENT DOCUMENTS

| | | | |
|---|---|---|---|
| 703,420 | 7/1902 | Hunter . | |
| 1,736,188 | 11/1929 | Daesen et al. | 222/595 X |
| 1,747,552 | 2/1930 | Lund . | |
| 1,843,491 | 2/1932 | Tornberg | 164/306 X |
| 2,735,148 | 2/1956 | Shannon et al. . | |
| 2,816,334 | 12/1957 | Edstrand | 222/595 X |
| 2,846,740 | 8/1958 | Edstrand | 222/595 X |
| 3,229,337 | 1/1966 | Holz et al. | 222/595 X |
| 3,499,580 | 3/1970 | Smith . | |
| 3,510,116 | 5/1970 | Harvill et al. . | |
| 3,675,911 | 7/1972 | Kapun . | |
| 3,708,088 | 1/1973 | Lesher | 222/595 |
| 3,834,587 | 9/1974 | Bengt et al. . | |
| 3,876,191 | 4/1975 | Lauersdorf . | |
| 4,158,382 | 6/1979 | Oxenreider et al. . | |
| 4,284,122 | 8/1981 | Oxenreider et al. . | |
| 4,289,193 | 9/1981 | Stamp . | |
| 4,730,755 | 3/1988 | Hayashi | 222/595 |

FOREIGN PATENT DOCUMENTS

| | | | |
|---|---|---|---|
| 460579 | 6/1928 | Fed. Rep. of Germany . | |
| 59-215265 | 12/1984 | Japan . | |
| 62-207558 | 9/1987 | Japan | 164/337 |
| 301372 | 6/1971 | U.S.S.R. | 222/595 |
| 547289 | 5/1977 | U.S.S.R. | 222/595 |

*Primary Examiner*—J. Reed Batten, Jr.
*Attorney, Agent, or Firm*—Foley & Lardner

[57] ABSTRACT

A pouring system uses low pressure air to force molten lead into mold cavities. The pour spout is heated by the lead bath, and, preferably, a small gap is maintained between the pouring spout and a weir on the mold cavity to prevent stringers from being attached to the cast piece. At the completion of the lead pouring operation, excess metal is drained back through the spout and into the lead bath. Lead volume is controlled by adjusting pressure and timer settings, and a fill hole allows the pump to refill.

22 Claims, 5 Drawing Sheets

LEAD POURING SYSTEM

BACKGROUND OF THE INVENTION

1. Field of the Invention

This invention relates generally to the art of pouring measured quantities of liquids, and more particularly to a low pressure air system for pouring molten metals. In its most preferred embodiment, the system is used for pouring lead straps in the manufacture of batteries.

2. Description of the Prior Art

Several systems presently exist for pouring molten metals, and some systems have been specially adapted for pouring lead, e.g. for use in the construction of batteries. In addition to the problems normally encountered with any molten metal pouring system, special problems exist in the manufacture of lead-acid batteries where lead straps and the like must be poured accurately quickly, efficiently and safely.

Prior systems include those where a pressurized gas has been used to force molten material from a container of molten lead out a spout. One such device employs measurement of the velocity of molten metal flowing through a spout as the determining factor, as shown in U.S. Pat. No. 3,675,911 issued Jul. 11, 1972 to Kapun for "Arrangement For Discharging Predetermined Amounts Of Molten Metal From A Vessel". Another employs a pair of reference electrodes spaced along one side of an outlet passage in the delivery spout, metal flowing between the two electrodes indicating that the level of molten metal has reached a certain height within the spout. Shot timer means are connected to the reference electrode and are activated when the molten metal has reached the predetermined height. This system is described in U.S. Pat. No. 3,876,191 issued Apr. 8, 1975 to Lauersdorf for "Furnace Ladling Apparatus And Crucible".

A device of the overflow variety is described in U.S. Pat. No. 4,289,193 issued to Stamp on Sep. 15, 1981 and entitled "Accumulator Plate Assembly Methods". This device includes a mold having a number of separate cavities arranged on either side of a duct. A weir is positioned between the duct and the individual mold cavities, the weir determining the level of lead to be poured. The lead pumped into the duct flows into the cavities over the weir. Once the casting operation is completed, lead from the duct flows back to the source pump, and an overflow return system is employed to maintain a constant level of lead in the duct after the mold cavities have been filled. The system includes an exit passage formed in the end of the duct near the air flow pump. A special valve cycling arrangement causes lead to be sucked back into the duct below the level of the weir. The level of lead in the duct then falls below the top of the weir, thereby causing the level of lead in the cavities to fall to the level of the top of the weir. After filling of the individual cavities, the battery plates are lowered by rams and are partially immersed. Due to the flow of cooling water into the cooling molds, the lead rapidly solidifies and is cast onto the lugs.

Systems are also known which use weighing devices for measuring the amount of molten material See Bengt et al. U.S. Pat. No. 3,834,587 issued Sep. 10, 1974 for "Means For Automatic Control Of Batching When Casting From A Heat-Retaining Casting Furnace Or Ladle (Crucible)". The batching ladle is weighed and the output signal of the weighing system is fed to a deriving device which controls the tapping of the furnace by control of output of air into the melting crucible.

A system employing air pressure and a bubbler tube is shown in U.S. Pat. No. 3,499,580 issued Mar. 10, 1970 to Smith for "Pressure Pour Apparatus And Component Thereof". A cushion of gas from a regulated pressure source aids gravity in maintaining a constant head to force liquid out through the pouring orifice.

Mechanical plungers are used in U.S. Pat. No. 703,420 issued Jul. 1, 1902 to Hunter for "Process Of Making Electric Accumulator Plates" and U.S. Pat. No. 1,747,552 issued Feb. 18, 1930 to Lund for "Grid Casting Machine". Mechanical pistons are also used in U.S. Pat. No. 4,158,382 issued Jun. 19, 1979 to Oxenreider et al. for "Apparatus For Casting Lead Into Plastic For Side Terminal Batteries", U.S. Pat. No. 4,284,122 issued Aug. 18, 1981 to Oxenreider et al. for "Method And Apparatus For Casting Lead Into Plastic For Side Terminal Batteries" and U.S. Pat. No. 2,735,148 issued Feb. 21, 1956 to Shannon et al. for "Process For Casting Storage Battery Straps And Terminals".

Other metal dispensing furnaces which employ air pressure are shown in U.S. Pat. No. 3,510,116 issued May 5, 1970 to Harvill et al. for "Metal Dispensing Furnace". In this patent, an inert gas supply is used to force air over a weir into a receiving area. A pouring spout which is inclined, is adapted to feed the molten lead into the mold cavity. A baffle separates a surge chamber and the dispensing chamber and is configured in such a way that upon release of the air pressure, a back flow of molten metal maintains a clearance between the two chambers resulting in agitation.

All of the aforementioned devices suffer from one or more disadvantages when applied to the large scale manufacture of castings, especially when casting straps in the manufacture of lead-acid batteries. The mechanical systems can foul and repair to the sliding components is time consuming and expensive. The devices which use high pressure air are also ineffective in producing precise quantities of lead. The system which uses the overflow from a duct into cavities across a weir requires complex valving for the pumping operations, and the duct system employed for maintaining the level of molten metal in a proper fluid state and at the proper level is complex and subject to periodic failure.

A system for pouring accurate amounts of molten metal, such as pouring accurate amounts of molten lead for battery strap casting operations, would represent a significant advance in the art.

SUMMARY OF THE INVENTION

The present invention provides a molten metal pouring system for casting operations, particularly an overflow lead pouring system for a casting station used in lead-acid battery manufacture, which overcomes the aforementioned disadvantages of the art. A feature of the present invention is the use of a simple pump having a spout used to direct molten lead to a mold cavity. In a preferred feature of the invention, the pouring spout is heated using heating rods embedded adjacent the spout and communicating with a portion of a pump body immersed in the molten lead, thereby eliminating the need for separate spout heating devices.

In a still further preferred feature of the invention, a weir is provided to separate the mold cavity from the pouring spout, and in the most preferred system, a space is provided between spout and weir to ensure that a stringer does not remain attached to the cast strap.

In the illustrated preferred embodiment, a system is provided for ensuring precise alignment of the individual pouring pumps and for preventing slag from fouling the pump refilling aperture.

How these and other features of the invention are accomplished will be described in the following detailed description of the preferred embodiment taken in conjunction with the drawings. Generally, however, they are accomplished by providing an individual pump housing for each mold cavity, the pump housing including a cylindrical bore having an air inlet. Low pressure air, which has been filtered and dried, is pumped into the upper portion of the housing for a controlled period of time at a controlled pressure. A pouring spout communicates with the bore of the housing and has an upper lip adjacent to, but spaced apart from, the mold cavity. In the most preferred form of the invention, a pair of copper rods are embedded adjacent the pouring spout, which rods conduct heat from the portion of the lead pump immersed in the lead bath.

In the illustrated and preferred embodiment of the invention, a fill hole is provided to allow molten metal to fill the pump chamber after air pressure is released. At the same time, the gap which exists between the mold cavity and the tip of the pouring spout breaks the molten metal flow, allowing molten lead to flow backwardly into the pump housing through the spout, thereby avoiding stringer problems.

In the illustrated embodiment, the individual pump housings are urged into contact with a mold block by a swing arm and are aligned using a pair of pins to insure precise positioning of the pump bodies adjacent the mold cavities.

Other features of the invention will become apparent to those skilled in the art after they read and understand the teachings of this application. Such features are deemed to be within the scope of the invention if they fall within the scope of the claims which follow.

BRIEF DESCRIPTION OF THE DRAWINGS

In the various figures, like reference numerals are used to indicate like components.

DETAILED DESCRIPTION OF THE PREFERRED EMBODIMENT

Before proceeding to the description of the preferred embodiment of the present invention, several comments need to be made about the adaptability of the present invention. While the invention is illustrated in the context of casting straps for lead-acid storage batteries, the invention has much wider applicability to other processes where the casting of molten metal, or for that matter, the pouring of precise amounts of other liquids, is required. Relative dimensions could be widely varied, as could the number of pumps employed for any particular casting operation. The illustrated embodiment shows twelve casting pumps, six on each side, as would be employed in the construction of a standard twelve volt battery for an automobile, but a different number of pumps could be employed for other kinds of batteries. Moreover, the present specification does not attempt to describe the other plate assembly and battery construction techniques involved in manufacturing lead-acid storage batteries, because in and of themselves, such techniques are well-known and do not form part of the present invention. Suffice it to say that the principles of the present invention are readily adaptable to manual, automated or robotic battery manufacturing systems.

Figure 2:
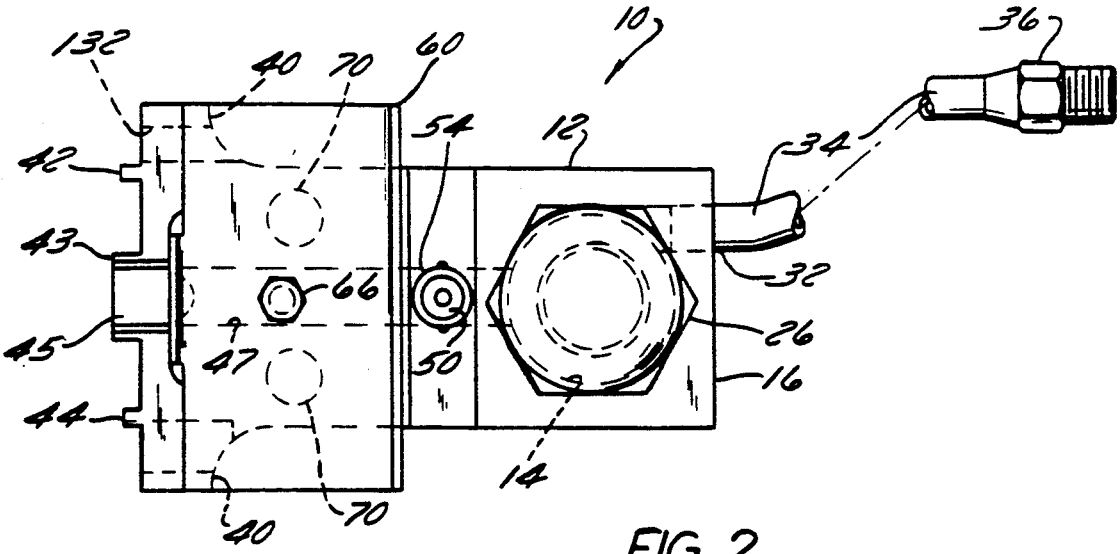
FIG. 2 is a top plan view of the pump shown in FIG. 1.
Figure 1:
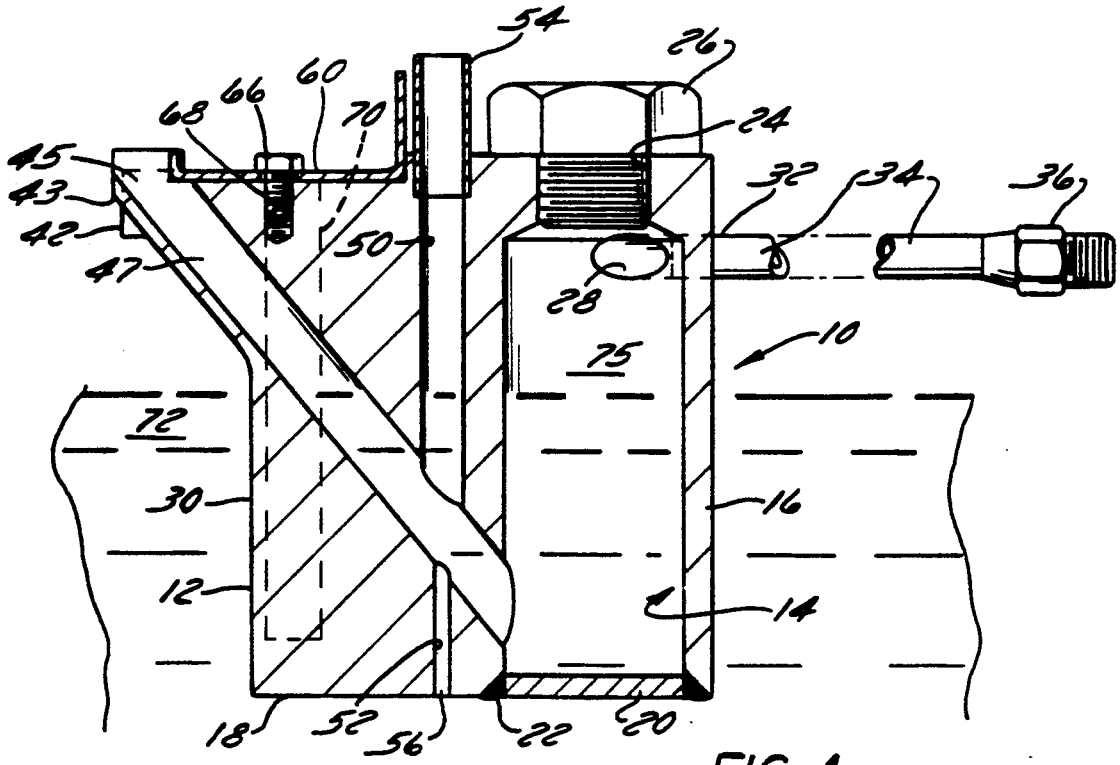
FIG. 1 is a side sectional view of one of the molten metal, low-pressure air pumps according to the preferred embodiment of the present invention.

Proceeding now to the description of the preferred embodiment, a casting pump 10 is shown in FIGS. 1 and 2. The pump 10 includes a body 12 (generally rectangular in horizontal or vertical cross section) and is preferably made from a steel which is suitable for immersion into liquid lead without degradation. Located at one end of body 12 is a generally cylindrical, vertically oriented chamber 14. Chamber 14 is preferably located just inwardly of a first end wall 16 of pump 10. Chamber 14 is made by machining through the bottom 18 of body 12. Upon completion of the preparation of chamber 14, a plate 20 is welded across the bottom as is shown by weld areas 22 in FIG. 1.

Chamber 14 extends a substantial distance upwardly into body 12 and terminates at its upper end in a reduced, diameter, threaded opening 24. A bolt 26 is threadingly received in opening 24 to sealingly close chamber 14. Careful machining of the top of body 12 and the underside of bolt 26, together with an anti-seize compound, will help to ensure an air-tight seal at this location. Also shown in FIG. 1 is a horizontal, through-hole 28 extending through the end wall 16 of body 12 into chamber 14, hole 28 being adapted to receive a first end 32 of an air supply pipe 34. The second end 36 of pipe 34 is a coupling, the purpose of which will become apparent later in this description of the preferred embodiment.

The end 30 of body 12 opposite from end wall 16 is flared outwardly near its top into extensions 40 (see FIG. 2) and three alignment projections 42–44 are carefully machined along the top edge of end 30 for abutment against the edge of the mold block which will be described later. The central extension 43 is actually the tip of a pouring spout 45. Spout 45 opens to an inclined, generally cylindrical passageway 47 extending downwardly from the top of body 12 toward the bottom of chamber 14. An intersecting, smaller, vertical hole 50 is machined through body 12 between chamber 14 and the tip 43 of spout 45, hole 50 having a larger diameter above it point of intersection with passageway 47 and a smaller diameter at the area 52 between passageway 47 and the bottom 18 of body 12. A short tube 54 is inserted into the top of hole 50. Area 52 terminates at a fill hole 56 at the bottom of body 12.

Other components of pump 10 include a spout cover 60 which is provided between tube 54 and the top edge of the pump adjacent spout 45. A bolt 66 passes through cover 60 and is threadingly received in a hole 68 in the top of body 12. Also shown in FIG. 2 are a pair of conductor rods 70 vertically received in body 12, one on either side of passageway 47. Rods 70 are preferably made from a material having a high level of heat conductivity, such as copper.

The operation of pump 10 will now be explained in general terms. Pump 10 will be placed into a container (described later) for the liquid to be, poured, such as a bath of molten lead 72. The liquid will flow into the pump chamber 14, passageway 47 and tube 50 through fill hole 56 and rise to the level of the liquid into which the pump is placed. Tube 50 is provided to insure that hole 56 remains open, and for that purpose, any type of elongate cleaning rod (not shown) may be inserted downwardly through tube 54. Similarly, opening 24 may be accessed for cleaning of chamber 14 (should that become necessary) by removal of bolt 26. Spout cover 60 is provided to keep contaminants away from molten lead in the spout area of the pump and to direct the molten lead into the mold cavities described hereafter. Together with rods 70, cover 60 assists in maintaining the passageway 47 at a temperature above the melting point of the lead. Rods 70 carry the heat of the molten lead upwardly into body 12 to a point well above the level of the molten liquid 72.

Pump 10 allows the pouring of a specific quantity of liquid 72 by injecting into chamber 14, through hole 28, a specific amount of pressurized air. The amount is determined by control of incoming air pressure and time. It will be apparent that as air is introduced into the air space 75 above the liquid level in chamber 14, liquid will be forced upwardly in passageway 47 in response thereto. Air injection is continued until the proper amount of lead has been dispensed from spout 45, after which time the area 75 is vented causing lead within the upper part of passageway 47 to fall. At the same time the chamber 14 is refilled by lead flowing inwardly through fill hole 56 because of the hydrostatic pressure generated by the bath 72. The compressed air system will be described more fully below, but it will be mentioned here that a solenoid valve is provided for pump 10 and that 60–90 grams of lead is poured in the most preferred embodiment using 1.0–1.5 psi air injected for approximately 2 seconds (1.5–2.5 seconds for a typical automobile battery application).

Figure 3:
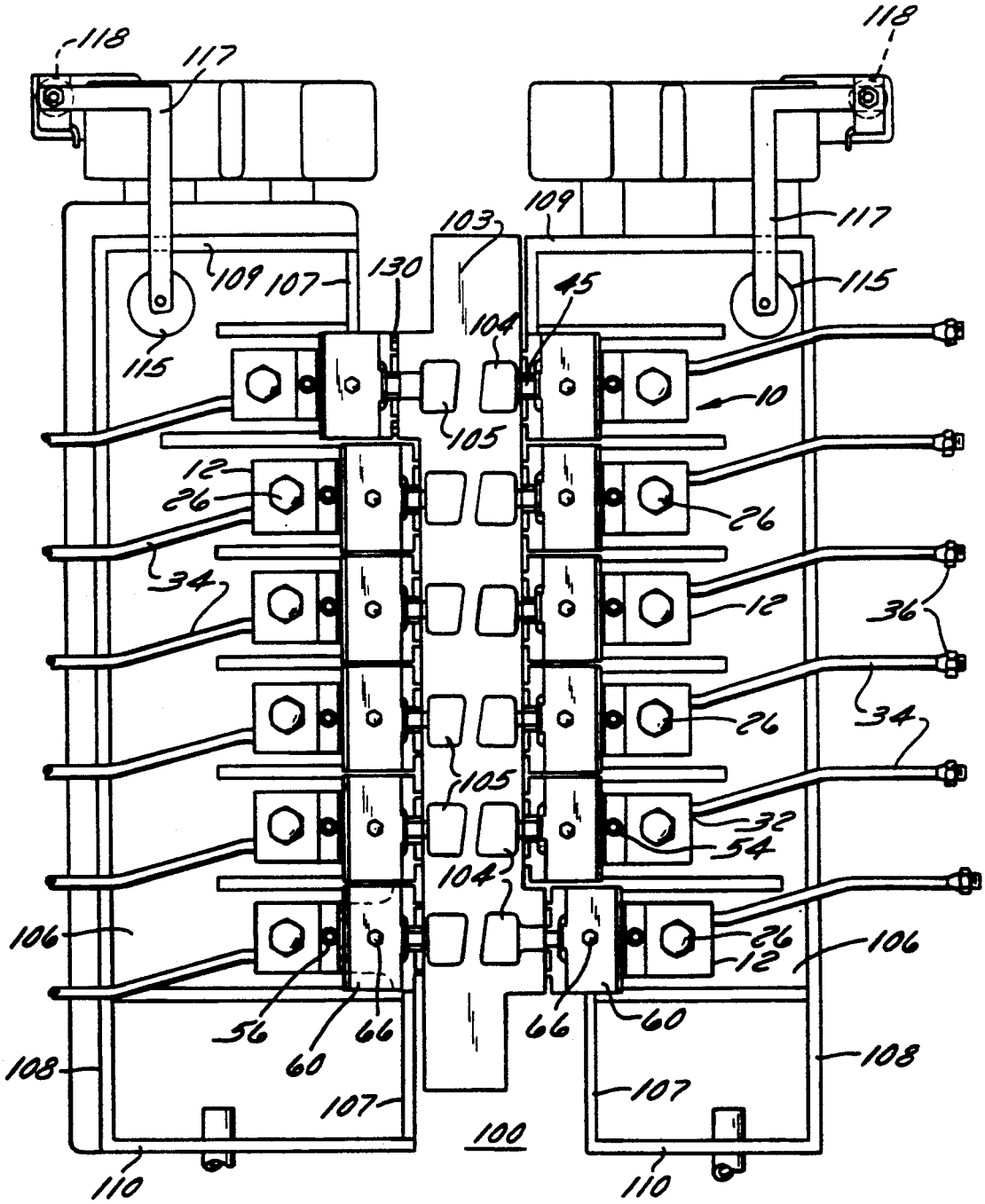
FIG. 3 is a top plan view of a battery strap casting station employing the pumps of the present invention, with certain features removed for clarity of explanation.
Figure 4:
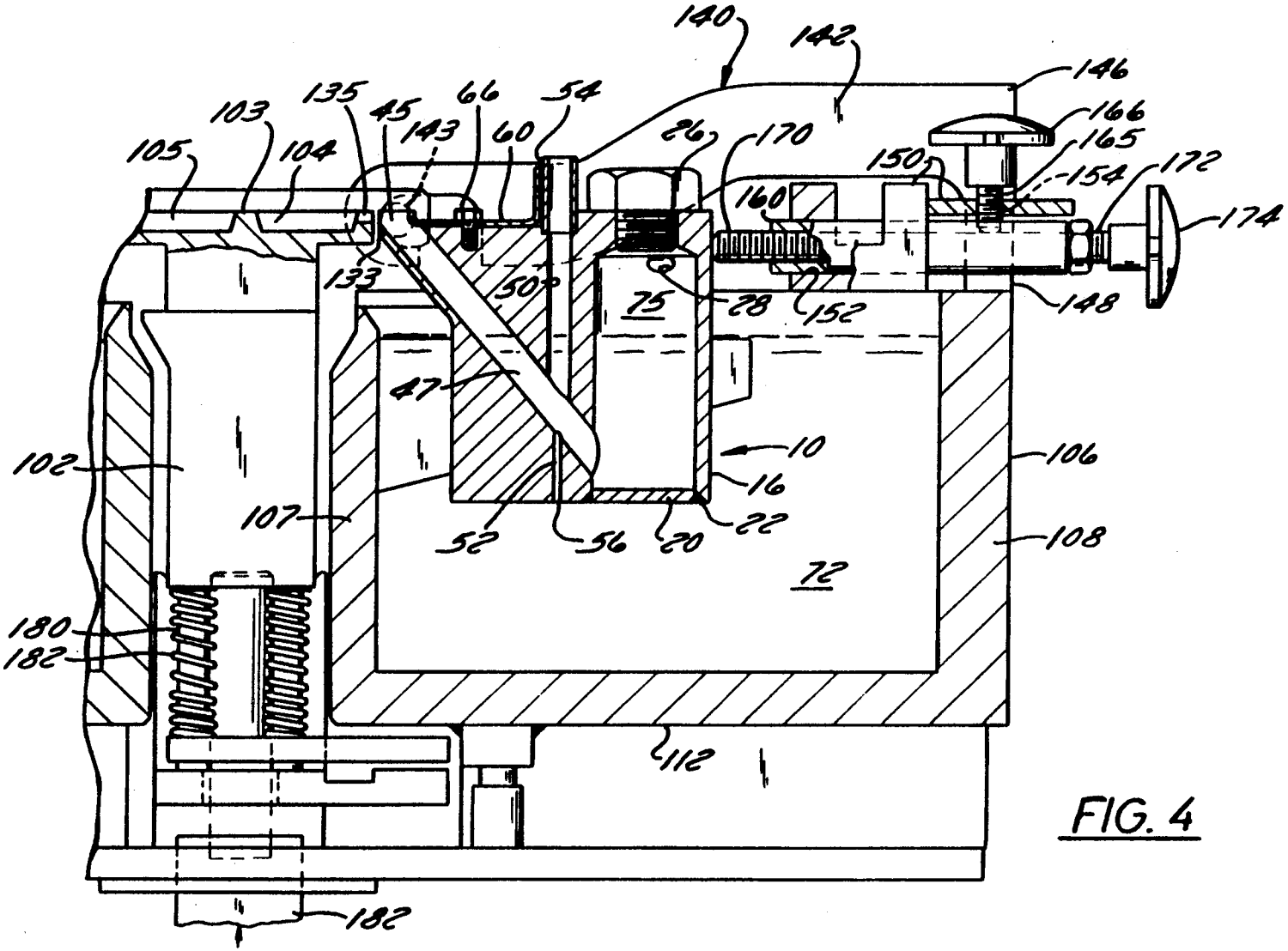
FIG. 4 is a side view, partially in section and illustrating a portion of the pump positioning system according to the preferred embodiment of the invention.

Proceeding now to a description of FIGS. 3 and 4, a typical battery accumulator casting station 100 is shown in top view, with parts removed or not shown in detail for ease of explanation. Station 100 includes an elongate mold manifold 102 for supporting a plurality of casting mold blocks, one of which is shown at 103. This blocks in turn include mold cavities, two of which are shown at 104 and 105. As previously mentioned, the number, size and arrangement of the cavities will depend primarily on the type, size and design of a particular battery. Manifold 102 preferably includes cooling passages below the molds for fluid coolants as known in the art and/or cooling air passages. Furthermore, a knock-out system may be employed, as is illustrated in greater detail in FIG. 4, to assist in removal of solidified parts from the cavities.

On either side of the manifold 102 is a lead pot 106 made from steel and including inner and outer walls 107 and 108 respectively, a first end wall 109, a second end wall 110 and a bottom 112 (see FIG. 4). Insulation is preferably used in the various walls and bottoms of pots 106 for energy conservation, operator safety and the maintenance of an even and controlled lead temperature within pots 106. Not shown in the figures are the pair of cast immersion heaters (3 kW in the most preferred embodiment) which are employed to maintain the lead temperature in pots 106 at about 850° F.

Near end walls 109, floats 115 are mounted on pivoting sensing arms 117 which in turn are coupled through sensing elements 118 to a lead pump in another lead pot (not shown). The latter lead pot is for a larger supply of lead (held at about 900° F.). A pump in the large pot maintains the level of lead 72 in pot 106 at or near the desired level. That level is not extremely critical. Deviations of about $\pm\frac{1}{8}''$ in level are acceptable for automotive battery manufacturing.

Figure 3A:
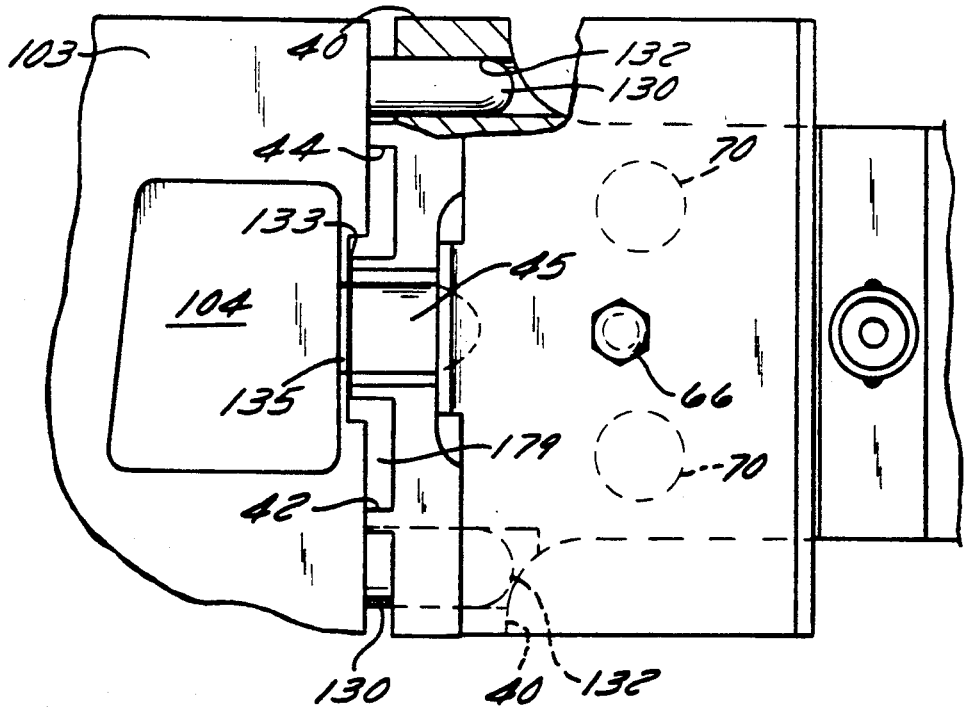
FIG. 3A is an enlarged top plan view of the spout/-weir relationship shown in FIG. 3.

Also as noted in FIG. 3, the pipes 34 extend outwardly from outer walls 108 for coupling to the air supply system soon to be described, and mounting pins 130 are shown on the mold blocks 103 (see FIG. 3A), a pair of which are provided for each pump 10 to assist in proper alignment thereof with the mold cavity. Pins 130 are received in holes 132 on either side of spout 45 in extensions 40. Together with projections 42–44, the pins insure a proper fit and alignment of the spout 45 with the mold block 103. As can best be seen in FIGS. 3 and 4, a small gap 133 on the order of 0.005 to 0.010 inch, is provided between the weir 135 of the mold casting (104 in this section). The gap assists in breaking the flow stream of molten lead when pouring is completed, allowing a reverse flow of lead into pump 10 and preventing the formation of undesirable stringers attached to the cast parts.

Figure 5:
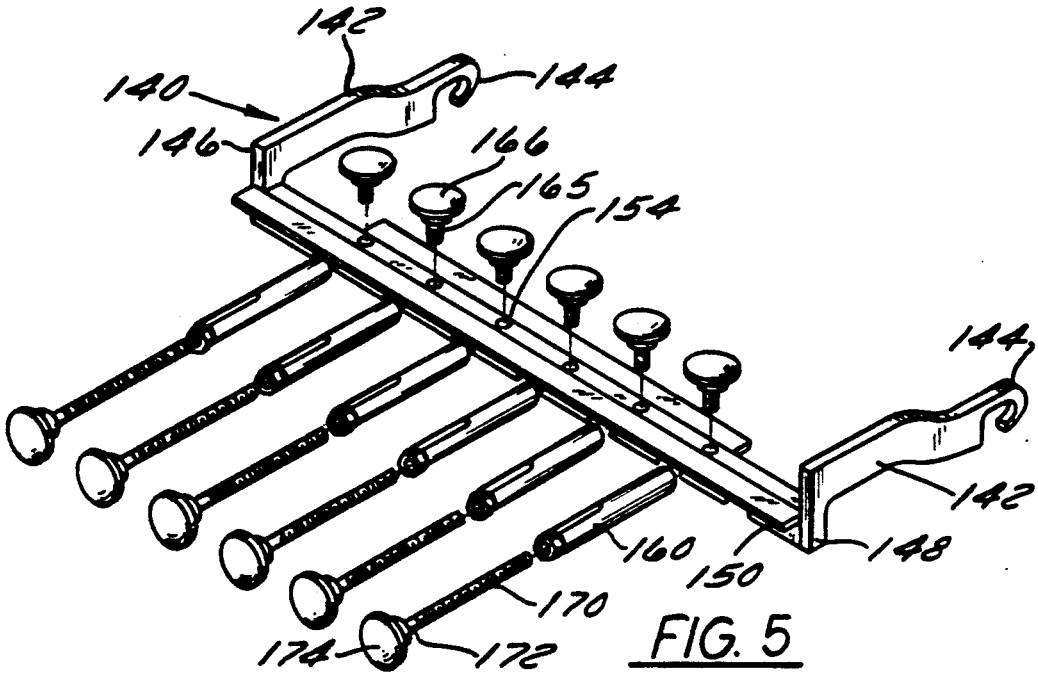
FIG. 5 is a perspective, exploded view of the swing arm assembly.

Pumps 10 are urged against the mold block 103 by an adjustable, pivotable swing arm assembly 140 shown best in FIGS. 4 and 5 (only one side is shown). Assembly 140 includes a pair of generally parallel plates 142 having a first hooked end 144 and an outer end 146. Ends 144 are adapted to pivot about pins 143 located on either end of the manifold 102. Outer ends 146 include a downwardly extending projection 148.

Mounted between projections 148 is a support 150 extending generally above the upper edge of the outer wall 108. A horizontal hole 152 is provided in support 150 for each pump 10, and a vertical intersecting and threaded hole 154 is provided for each horizontal hole 152. An internally threaded cylinder 160 is loosely received through each of the holes 152 and is adjustably locked into position by bolts 165 inserted into holes 154. A turning handle 166 is provided to facilitate tightening and loosening of bolts 165.

The cylinders 160 each receive a threaded rod 170 the outer end 172 of which is secured to a handle 174. The inner end 176 of the rods 170 is adapted to abut the outer wall 16 of pump 10 when cylinders 160 are properly positioned.

It will be appreciated then that by appropriate tightening and loosening of the two handles 166 and 174, pumps 10 will be firmly positioned, through projections 42–44 against the mold block 103 and that pins 130 will be placed into receiving holes 132. It will also be apparent that if all the rods 170 are moved away from the pumps, and if cylinders 160 are retracted, the entire swing arm assembly may be pivoted upwardly to provide access to the pumps 10 for maintenance. The air gap 179 between the mold blocks 103 and the pumps 10, as maintained by projections 42–44, prevents undesirable heat transfer from the hot pump 10 to the cooler mold blocks 103.

Also shown in FIG. 4 are rods 180 and springs 182 which are part of the knock-out assembly which itself is known. The driver cylinder 184 of the preferred hydraulic variety of knock-out device is also shown in FIG. 4.

Figure 6:
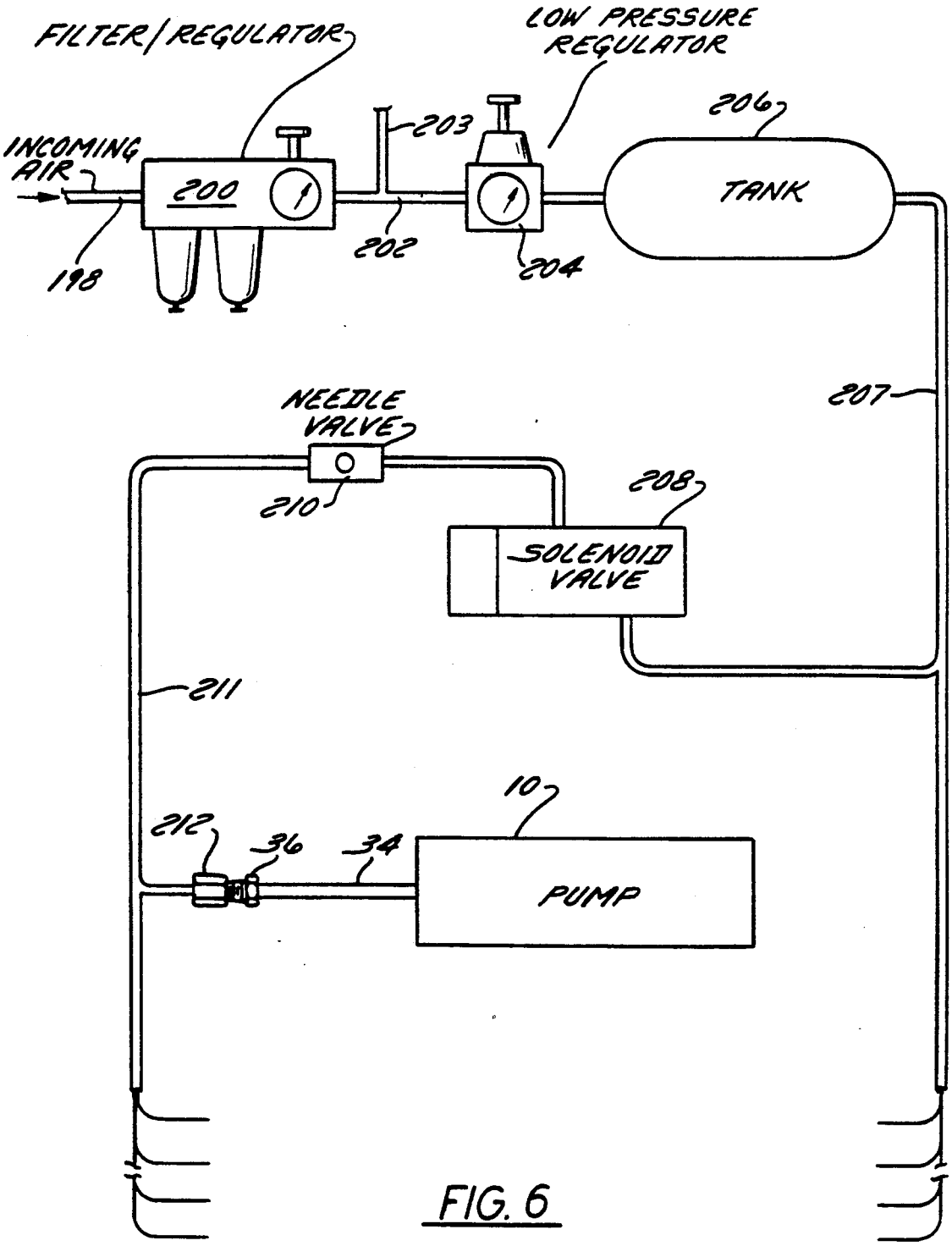
FIG. 6 is an air flow and valve schematic for use in the illustrated preferred embodiment.

Referring next to FIG. 6, a schematic of the system used to supply and control the air flow to pipes 34 is shown. Air from a compressor (not shown) enters the system through a pipe 198 at about 80 psi and enters a filter/regulator 200 where it is purified or dried. A low pressure regulator 204 is located downstream of filter/-regulator 200 and a T 202, a branch 203 of which supplies other needs of the battery making equipment unrelated to the present invention. The regulator 204 drops the pressure to about 1.2 psi in the preferred embodiment and it is maintained at that pressure in a large accumulator tank 206. A pipe 207 supplies air from tank 206 to twelve solenoid controlled valves 208 (one of which is shown in this figure) which in turn selectively feeds air through a needle valve 210 to a pipe 211 leading toward pump 10. A coupling 212 on the end of pipe 211 joins to the coupling 36 of pipe 34. As mentioned previously, the valve 208 allows air to flow into the pump chamber 14 for a preselected period of time, after which air is vented through valve 210A solenoid 208 and the downstream components are provided for each pump 10 in the preferred embodiment.

While an illustrated preferred embodiment of the invention has been described above, the invention could be variously embodied without departing from its intended scope. It is, therefore, to be limited solely by the scope of the claims which follow.

What is claimed is:

1. A system for pouring a liquid into a receptacle comprising a receptacle, a bath of the liquid, a low pressure air source, a pump housing having a chamber for containing the liquid, the housing being at least partially immersed in the bath and having a refilling hole communicating with the bath, a discharge passageway communicating with the chamber and terminating in a pouring spout, a conduit for coupling the air source to the chamber, valve and timer means for admitting a predetermined amount of said low pressure air from the source through the conduit and into the chamber force a predetermined quantity of the liquid through the passageway and out of the spout, said receptacle being adjacent to but spaced apart form the spout, the system further comprising spacer means on the housing for maintaining a predetermined spacing between the spout and the receptacle and means for urging the spacer means on the pump housing against the receptacle so that the spacing therebetween is maintained at the predetermined spacing.

2. The pouring system of claim 1 wherein the liquid is a molten metal and wherein the receptacle is a mold.

3. The pouring system of claim 2 wherein the molten metal is a lead containing molten metal.

4. The pouring system of claim 3 wherein the mold is a battery strap mold.

5. The pouring system of claim 1 wherein the chamber is a generally cylindrical, vertically oriented chamber, the passageway is an inclined tubular passageway intersecting the chamber at a lower portion thereof and the conduit admits the low pressure air at an upper portion of the chamber.

6. The pouring system of claim 5 wherein the refilling hole is provided in the housing between the bath and the passageway.

7. The pouring system of claim 6 wherein a clean-out hole is provided above the passageway in the housing, said refilling and clean-out holes being axially aligned.

8. The pouring system of claim 2 wherein the mold includes a weir adjacent the spout and arranged so that the molten metal flows over the weir when forced out of the spout.

9. The pouring system of claim 8 wherein the spout is spaced from said weir by an amount of about 0.005 to 0.010 inches.

10. The pouring system of claim 1 wherein the low pressure air is air at a pressure of about 1-1.5 psi.

11. The pouring system of claim 4 wherein the low pressure air is air at a pressure of about 1-1.5 psi and wherein the timer means admits the low pressure air for about 1.5 to 2.5 seconds.

12. The pouring system of claim 1 wherein thermal conductive metal rods are embedded in the housing for heating the passageway.

13. The pouring system of claim 12 wherein the rods are copper.

14. A system for pouring a heated liquid from a bath thereof into a receptacle comprising a low pressure air source, a pump housing having a chamber for containing the liquid, a discharge passageway communicating with the chamber and terminating in a pouring spout, a conduit for coupling the air source to the chamber, valve and timer means for admitting a predetermined amount of low pressure air from the source, through said conduit, and into the chamber to force a predetermined quantity of the liquid through the passageway and out of the spout, and thermal conductive metal rods being embedded in the housing in the vicinity of both the passageway and the bath for heating the passageway.

15. The pouring system of claim 14 wherein the rods are copper rods.

16. A system for pouring a liquid into a mold comprising a mold, a liquid bath a low pressure air source, a pump housing having a chamber for containing the liquid, a discharge passageway communicating with the chamber and terminating in a pouring spout, a conduit for coupling the air source to the chamber, valve and timer means for admitting a predetermined amount of said low pressure air from the source through the conduit and into the chamber to force a predetermined quantity of the liquid through the passageway and out of the spout, the housing being at least partially immersed in the bath and a hole being provided therein for refilling the chamber from the bath, the hole passing through the pump housing and communicating with the passageway, and wherein the chamber is a generally cylindrical, vertically oriented chamber, the passageway is an inclined tubular passageway intersecting the chamber at a lower portion thereof and the conduit admits the low pressure air at an upper portion of the chamber, a clean-out hole being provided above the passageway in the housing, said refilling and clean-out holes being axially aligned.

17. The pouring system of claim 16 wherein the liquid is a molten metal.

18. The pouring system of claim 17 wherein the spout is adjacent to but spaced apart from the mold by a distance of about 0.005 to 0.10 inches.

19. The pouring system of claim 18 wherein the mold includes a weir between the mold and the spout arranged so that the molten metal flows over the weir when forced out of the spout.

20. The pouring system of claim 16 wherein the low pressure air is air at a pressure of about 1-1.5 psi.

21. The pouring system of claim 20 wherein means are provided for heating the passageway.

22. The pouring system of claim 21, wherein the heating means are copper rods embedded in the housing.

* * * * *

UNITED STATES PATENT AND TRADEMARK OFFICE

CERTIFICATE OF CORRECTION

PATENT NO. : 5,146,974

DATED : September 15, 1992

INVENTOR(S) : MAYER, Robert W.; NOWAKOWSKI, James B.; PUSEY, Bruce A. and SHAH, Kashyap H.

It is certified that error appears in the above-identified patent and that said Letters Patent is hereby corrected as shown below:

Column 7,

In claim 1, line 40, please insert the word "to" after the word --chamber--;

In claim 1, line 43, please change the word "form" to --from-- after the word --spaced apart --.

Signed and Sealed this

Seventh Day of December, 1993

Attest:

Bruce Lehman

BRUCE LEHMAN

Attesting Officer

Commissioner of Patents and Trademarks